United States Patent [19]

Hale

[11] Patent Number: 4,768,494

[45] Date of Patent: Sep. 6, 1988

[54] IDLING SYSTEM FOR MULTI-CYLINDER TWO-STROKE ENGINE

[75] Inventor: David J. Hale, Pickett, Wis.

[73] Assignee: Brunswick Corporation, Skokie, Ill.

[21] Appl. No.: 94,654

[22] Filed: Sep. 9, 1987

[51] Int. Cl.[4] ..... F02B 13/00

[52] U.S. Cl. ..... 123/579; 123/198 F; 261/41.5

[58] Field of Search ..... 123/198 F, 198 DB, 481, 123/579; 261/41.5

[56] References Cited

U.S. PATENT DOCUMENTS

| | | | |
|---|---|---|---|
| 1,717,768 | 6/1929 | Fornaca | 123/198 F |
| 1,882,793 | 10/1932 | Fitzsimmons | 123/198 F |
| 2,247,299 | 6/1941 | Klavik | 123/56 BC |
| 2,623,617 | 12/1952 | Snyder et al. | 123/198 F |
| 2,657,789 | 4/1954 | Watkins et al. | 123/41.13 |
| 2,745,391 | 5/1956 | Winkler, Jr. | 123/90.16 |
| 3,192,706 | 7/1965 | Dolza | 123/198 F |
| 3,400,702 | 9/1968 | Watkins | 123/198 F |
| 3,410,539 | 11/1968 | Walker | 261/41.5 |
| 3,761,063 | 9/1973 | Shibanaka et al. | 261/41.5 |
| 4,024,850 | 5/1977 | Peter et al. | 123/198 F |

*Primary Examiner*—E. Rollins Cross

*Attorney, Agent, or Firm*—Andrus, Sceales, Starke & Sawall

[57] ABSTRACT

An idling system for a multi-cylinder two-stroke engine as used in an outboard motor. Through a porting arrangement in the carburetor of at least one of the cylinders, the fuel supplied to that cylinder at idle and off-idle speed is reduced to a value so that the fuel-air ratio is too lean to fire. On rapid acceleration from idle speed, a charge of fuel is injected directly to the non-firing cylinder to provide smooth acceleration.

13 Claims, 3 Drawing Sheets

IDLING SYSTEM FOR MULTI-CYLINDER TWO-STROKE ENGINE

BACKGROUND OF THE INVENTION

Two-stroke, multi-cylinder engines have been plagued with problems of misfiring and generally rough running at idle and light loads. The principle cause of misfires is the extreme dilution of the fresh fuel charge with exhaust products. Because there is so little combustible mixture in the cylinder, the probability of ignition is extremely small. In addition, and particularly in multi-cylinder engines having interconnected exhaust ducts, there are pressure waves which, while highly beneficial at high speeds, interfere with the scavenging process at low speeds.

Various attempts have been made in the past to overcome misfiring and rough running at idle and low speeds. For example, it has been proposed to interrupt the ignition in one or more cylinders by grounding the spark plug associated with the cylinders. In another proposal, one or more cylinders are retarded in throttle advance progression so as to reduce power on that cylinder unitl a given speed is reached. However, none of these proposals have been entirely satisfactory, for they tend to produce an abrupt transition as the firing of cylinders is interrupted or re-established.

SUMMARY OF THE INVENTION

The invention is directed to an idling system for a multi-cylinder two-stroke engine which provides a smooth transition from idling speeds to high speeds.

In accordance with the invention, the idling arrangement is achieved by modifying the construction of the fuel inlet ports and the shutter valve in the carburetor of at least one of the cylinders in the bank, so that under idle speed conditions, the supply of fuel to that cylinder or cylinders is reduced to produce a fuel-air ratio too lean to fire. More particularly, the engine includes two or more cylinders, and a separate carburetor is provided for each of the two cylinders. Each carburetor includes an air passage which can be closed and opened by pivotal movement of a shutter valve. The shutter valve of each carburetor is provided with an opening or hole through which air is drawn at idle speeds to provide a fuel-air mixture.

Each carburetor has an idle discharge port for supplying fuel to the carburetor, and the idle port is exposed to the downstream side of the shutter valve when the valve is in the closed position. In addition, each carburetor has at least one off-idle discharge port, spaced longitudinally in the upstream direction from the idle port, and the off-idle port is located on the upstream side of the shutter valve, when the valve is in the closed position. In the cylinder, or cylinders, which are not to be fired at idle speed, referred to as "non-firing cylinders", the flow of fuel to the carburetor is restricted, such as by providing the idle port with a restrictive orifice. In addition, in the non-firing cylinders, the off-idle port is spaced a greater distance upstream from the peripheral edge of the closed shutter valve than in the firing cylinders.

The shutter valves of both the firing and non-firing cylinder are operated in unison, and under idle speed conditions, sufficient fuel will be supplied to the carburetors of the firing cylinders, through the idle ports, to provide a combustible fuel-air mixture. However, under idle condition, insufficient fuel will be supplied through the restricted idle ports of the non-firing cylinders, so that the mixture will be too lean to fire.

Thus, under idle and off-idle conditions, the firing cylinders have a sufficiently rich charge that they fire every revolution of the crank to provide a very smooth idle, similar to a four stroke engine, while the charge supplied to the non-firing cylinder, or cylinders, is too lean to fire.

As the throttle is advanced beyond off-idle conditions, the shutter valve of the non-firing cylinders will be moved to a predetermined position toward the open position to expose the off-idle ports to the downstream side of the shutter valve, to thereby draw fuel through said off-idle ports and provide a sufficiently rich mixture for combustion.

Through the system of the invention, a very smooth idle is produced with less visible smoke because of the more complete and regular combustion in the firing cylinders and due to the fact that very little fuel passes the non-firing cylinders.

As a further advantage, fuel consumption is reduced over a conventional system. While somewhat more fuel, approximately 25%, is admitted to the firing cylinders during idle, some 50–75% less fuel is fed to the non-firing cylinders, with the net result that the fuel consumption is reduced at idle and off-idle speeds. Further, hydrocarbon emissions, while the same at higher speeds, are much less when operating in the idle and off-idle modes with non-firing cylinders, as compared to a conventional engine.

Since a small amount of fuel-oil mixture is introduced into the non-firing cylinders at idle conditions, lubrication and corrosion protection is achieved, as opposed to a system which prevents the fuel from entering the non-firing cylinders.

As an added aspect of the invention, a provision can be included in the system to inject a charge of fuel directly into the non-firing cylinders on rapid acceleration from idle to high speeds, as may occur during water skiing or the like. In this regard an accelerator pump is operably connected to the throttle linkage and is connected in a by-pass fuel line. On rapid acceleration, the throttle linkage will operate the accelerator pump to increase the pressure of the fuel in the by-pass line, due to the presence of a restrictor, to thereby unseat check valves and permit a charge of fuel to be injected directly into the non-firing cylinders.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The invention is directed to an idle system for a multi-cylinder, two-stroke internal combustion engine in which the fuel-air mixture supplied to at least one of the cylinders at idle and off-idle speeds is too lean to fire. The invention has particular application to a four cylinder in-line engine, as used in an outboard motor which has interconnected exhaust ducts where pressure waves interfere with the scavenging process at low speeds. By cutting out one or more cylinders at low speeds, the interfering pulses are eliminated. The engine itself can be of the type shown in U.S. Pat. Nos. 3,692,006 or 4,484,442.

Figure 7:
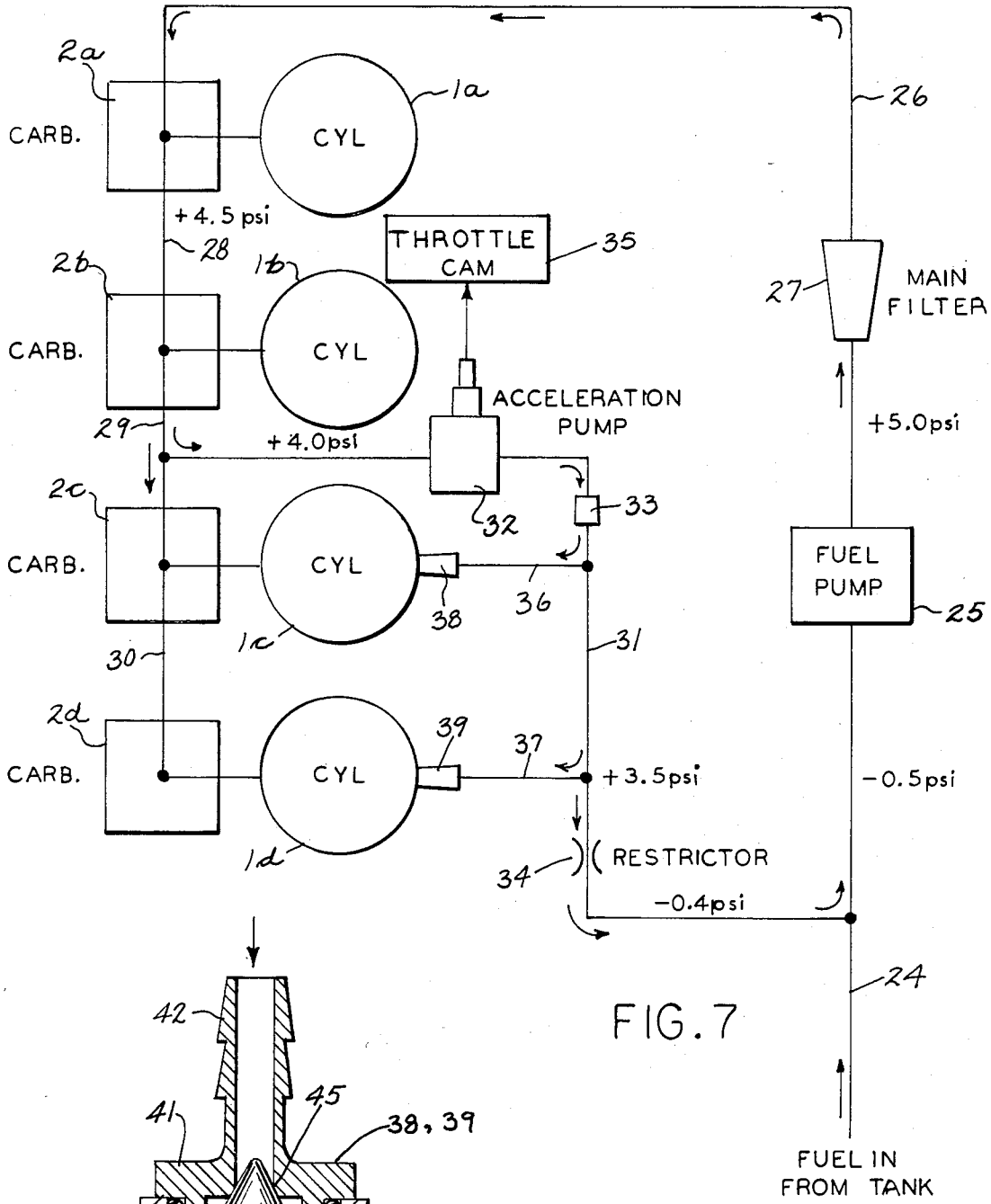
FIG. 7 is a flow diagram showing the system incorporating an accelerator pump.

As illustrated in FIG. 7, the engine includes four cylinders 1, which are arranged in a vertical in-line relation and a carburetor 2 is associated with each cylinder. The basic construction of carburetors 2 is conventional and each carburetor includes a casing 3 which defines a central air passage 4. Fuel is admitted to the casing 3 through a fuel inlet 5 and the fuel flow is regulated by a needle valve 6 that is adapted to engage a seat 7. Needle valve 6 is controlled by a float 8 to admit fuel to the reservoir 9. The fuel flows through a main fuel jet 10, and through an idle tube 11 to chamber 12. A main distribution tube 13 also communicates with fuel jet 10.

Figure 1:
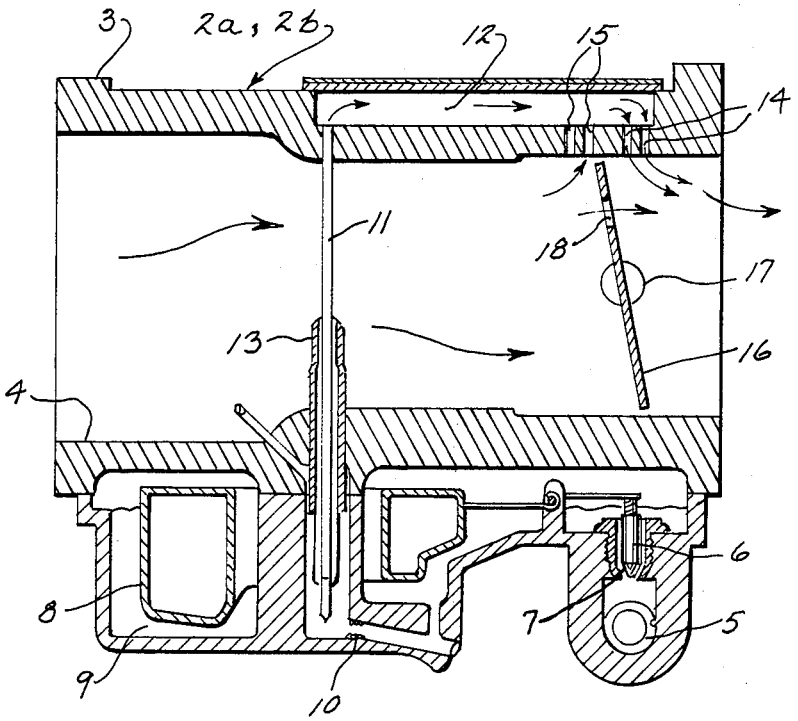
FIG. 1 is a schematic view of a conventional carburetor as used with a multi-cylinder, two-stroke engine with the shutter valve being shown in the closed position under idle condition.
Figure 2:
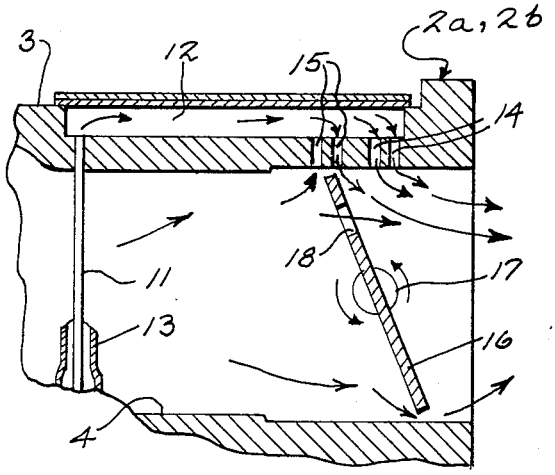
FIG. 2 is a view similar to FIG. 1 showing the shutter valve in an off idle condition.
Figure 3:
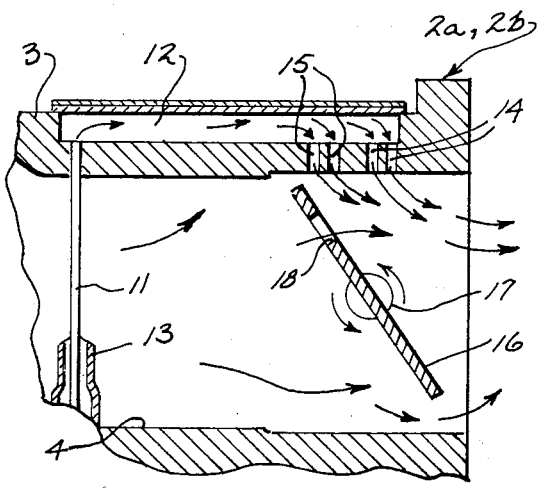
FIG. 3 is a view similar to FIG. 1 showing the shutter valve in an off idle higher speed condition.
Figure 4:
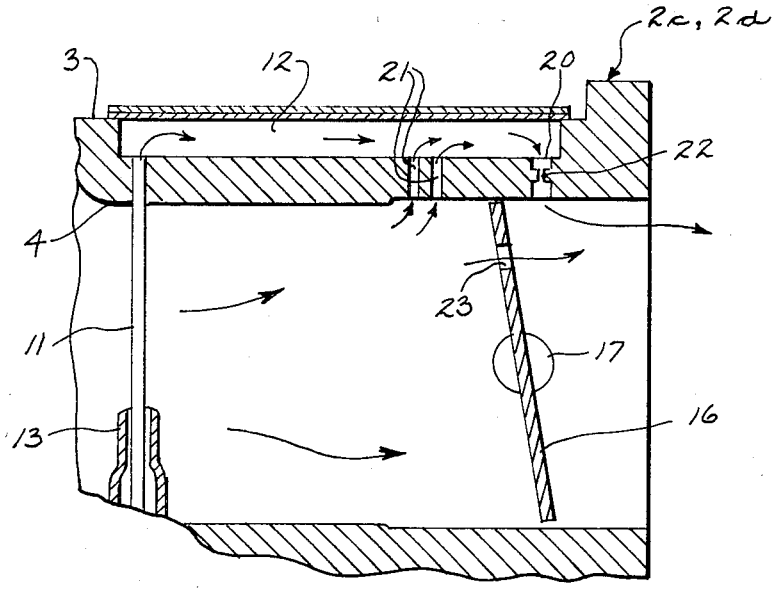
FIG. 4 is a fragmentary schematic view of the carburetor as associated with the non-firing cylinders of the engine with the shutter valve being shown in the closed position under idle condition.
Figure 5:
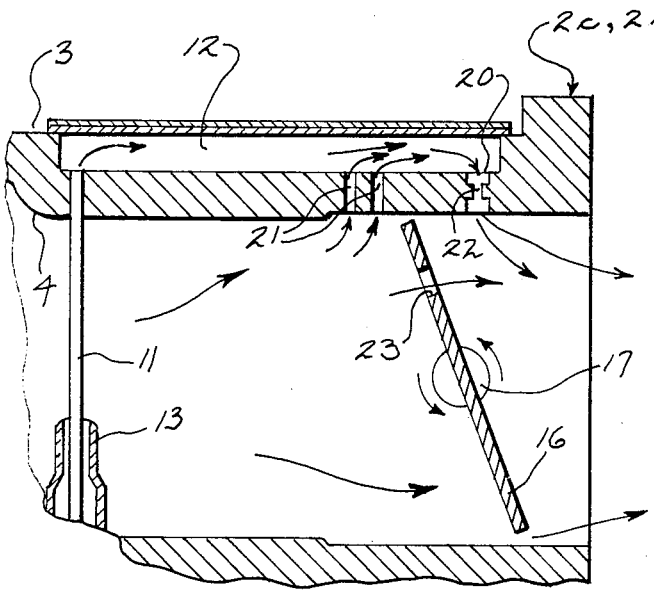
FIG. 5 is a view similar to FIG. 4 showing the shutter valve in the off idle condition.
Figure 6:
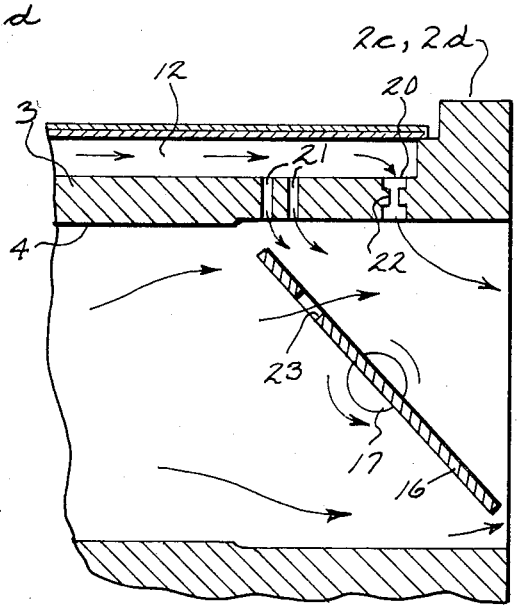
FIG. 6 is a view similar to FIG. 4 showing the shutter valve in an off idle, higher speed condition.

The construction of the carburetors of the two uppermost cylinders 1*a* and 1*b* in the bank, is shown in FIGS. 1–3, while the construction of the carburetors associated with the two lower cylinders 2*c* and 2*d* is illustrated in FIGS. 4–6. Cylinders 2*c* and 2*d* are non-firing cylinders at idle and off-idle conditions. With an in-line vertical bank of cylinders, the non-firing cylinders are preferably at the lower end of the bank due to the temperature distribution within the bank.

In carburetors 2*a* and 2*b* of the firing cylinders 1*a* and 1*b*, as shown in FIGS. 1–3, a pair of idle discharge ports 14 provide communication between chamber 12 and passage 4, and a plurality of off-idle discharge ports 15 also provide communication between chamber 12 and passage 4, but are located upstream of ports 14.

A conventional shutter or butterlfy valve 16 is mounted for pivotal movement in passage 4 about a shaft 17 and shutter valve 16 is provided with a hole or opening 18.

In accordance with the invention, at idle conditions the two uppermost cylinders 1*a* and 1*b* in the bank will fire normally, while the two lowermost cylinders 1*c* and 1*d* will not fire at idle conditions.

At idle speeds of approximately 700 rpm, the shutter valves 16 of the carburetors 2*a* and 2*b* of the firing cylinders will be in the position, as illustrated in FIG. 1. In this condition, fuel will be supplied through the exposed idle ports 14 and air will be supplied through the hole 18 to provide a normal fuel-air mixture that can be ignited.

As the throttle is advanced to an off-idle speed of approximately 1200 rpm, the shutter valves 16 of the firing cylinders will pivot to the position shown in FIG. 2 to permit additional fuel to be introduced through one of the off-idle ports 15 and additional air will be supplied around the periphery of the valve. Again, this will provide a normal fuel-air ratio for ignition.

FIG. 3 shows the condition of the carburetors 2*a* and 2*b* of the firing cylinders at a higher off-idle speed of approximately 1800 rpm. In this condition, fuel is supplied through both the ports 14 and 15 to provide a normal fuel-air mixture for proper ignition.

The construction of the carburetors 2*c* and 2*d* for the non-firing cylinders 1*c* and 1*d* is illustrated in FIGS. 4–6. The construction of the carburetors is basically the same as that previously described, except for the arrangement of the idle and off-idle ports. More specifically, the carburetors 2*c* and 2*d* are provided with an idle discharge port 20 and a plurality of off-idle discharge ports 21. However, the spacing between the off-idle ports 21 and the peripheral edge of the shutter valve 16, when the valve is in the closed position, is greater than that of the carburetors for the firing cylinders. Further, a restrictive orifice 22 is disposed within the port 20 to restrict the flow of fuel through this port.

FIG. 4 illustrates the condition of the carburetors 2*c* and 2*d* for the non-firing cylinders at idle speed of approximately 700 rpm. In this idle condition, the shutter valve 16 is closed and a small amount of fuel is introduced through the restrictive orifice 22. Due to the restricted amount of fuel, the mixture is too lean to ignite.

The condition of the carburetors 2*c* and 2*d* of the non-firing cylinders at an off-idle speed of approximately 1200 rpm is illustrated in FIG. 5. At this speed, the shutter valve 16 has pivoted to a slightly open condition and fuel is drawn into the carburetor only through the restrictive orifice 22, so that the mixture is still too lean to fire.

At higher off-idle speeds, such as 1800 rpm, as illustrated in FIG. 6, the shutter valve 16 has further pivoted toward an open position, to expose the off-idle ports 21, so that fuel is then drawn to the carburetor through both the off-idle ports 21 and the restrictive orifice 22. Under this condition, there is sufficient fuel to provide a fuel-air ratio that can be ignited.

Thus, in accordance with the invention, fuel is supplied to the non-firing cylinders at idle speeds, but the amount of fuel is restricted to provide a mixture too lean to fire. As the throttle is advanced to a predetermined speed, the proportion of fuel is increased, as shown in FIG. 6, to provide a proper fuel-air mixture for ignition. This system provides a four-stroke-like smoothness at idle and low speeds, which virtually eliminates smoke and provides the operator with a high degree of confidence that the engine will keep running under all conditions of slow speed maneuvering. While some additional fuel is supplied to the firing cylinders at idle, the fuel supply is reduced to the non-firing cylinders, so that the net result is lower fuel consumption at idle and low speeds.

Further, hydrocarbon emissions, while the same at higher speeds, are much less when operating at idle and slow speeds in comparison to a conventional engine.

Due to the fact that the fuel-oil mix is introduced into the non-firing cylinders at idle conditions, the non-firing cylinders are lubricated and protected against corrosion.

As a further aspect of the invention, a provision is made to supply an additional charge of fuel to the non-firing cylinders during rapid acceleration from idle, such as occurring in water skiing. FIG. 7 is a flow diagram illustrating the incorporation of an acceleration pump in the system to supply a charge of fuel to the non-firing cylinders. As shown in FIG. 7, the main fuel line 24 is connected to fuel pump 25 and fuel is discharged by the pump 25 through line 26 to carburetor 2*a* of cylinder 1*a*. A filter 27 is connected in line 26. Fuel is supplied from carburetor 2*a* to carburetor 2*b* through line 28 and similarly, the fuel is supplied from carburetor 2*b* to carburetor 2*c* through line 29 and from carburetor 2*c* to carburetor 2*d* through line 30.

In addition, a by-pass line 31 is connected between line 29 and the main fuel line 24 and an acceleration pump 32 is mounted in line 31 along with a filter 33 and a restrictor or small-diameter orifice 34.

As shown in FIG. 7, the pressure of the fuel being drawn to pump 25 is in the order of −0.5 psi and the pressure of the fuel discharged from the pump through line 26 is about 5.0 psi. The pressure drops to about 4.0 psi in bypass line 31 and further drops to about +3.5 psi downstream of the filter 33. The restrictor 34 is provided with a cross-sectional area sufficient to drop the pressure of the fuel to a value of −0.4 psi, similar to that of the pressure in the incoming line 24.

Acceleration pump 32 is a conventional type and can take the form of a diaphragm pump. Pump 32 is operated through a linkage to the throttle cam 35. As the throttle cam 35 is advanced to increase the engine speed, the pump will supply a charge of fuel at increased pressure through the line 31.

Connected to line 31 are a pair of injector lines 36 and 37 and injector nozzles 38 and 39 are mounted in lines 36,37 respectively. Injector nozzles 38 and 39 are each connected to the boost passage of the cylinders 1*c* and 1*d*, respectively.

Figure 8:
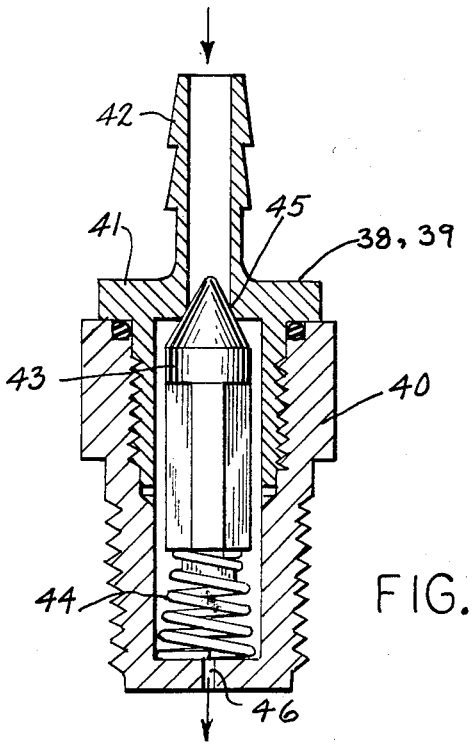
FIG. 8 is a longitudinal section of an injector nozzle.

The construction of the injector nozzles 38,39 is best illustrated in FIG. 8. Each nozzle includes a cup-shaped body 40, the open end of which is enclosed by a threaded cap 41. Stem 42 is integrally formed with cap 41 and is connected to the respective lines 36 and 37.

Mounted within body 40 is a bullet-shaped check valve 43 and the valve is biased by a spring 44 against a seat 45. The base of body 40 is provided with a discharge orifice 46, which communicates with the boost passage of the respective cylinder.

The check valves 43 of nozzles 38 and 39 are designed to be unseated by a pressure in the range of about 13 psi, and when unseated, a charge of fuel will be discharged through each orifice 46 to the respective cylinders 1*c* and 1*d*.

During normal operation of the engine, at either idle or high speeds, a portion of the fuel will flow through bypass line 31 and acceleration pump 32 and be returned to the main fuel line 24. The restrictor 34, as previously mentioned, drops the pressure of the fuel back to the fuel pump inlet value, but still allows a small flow of fuel through the bypass line at all times. The purpose of this flow is to sweep out any air retained in the lines during assembly, or any vapor which may form due to high temperatures. These gases will then flow around to the carburetors where they are vented through the float needle valve.

At idle speeds, the flow of fuel is restricted to cylinders 1*c* and 1*d*, so that these cylinders will not fire. If the throttle is then advanced rapidly for acceleration, pump 32 will be operated through the throttle lever linkage to increase the pressure of the fuel in the portion of line 31 between the pump 32 and the restrictor 34, to a value where the check valves 43 in the nozzles 38 and 39 will be unseated, to cause a charge of fuel to be injected to the non-firing cylinders 1*c* and 1*d*.

On the other hand, if the throttle is advanced from idle speed in a gradual manner, the increase in pressure caused by actuation of the acceleration pump will not be sufficient to unseat the check valves 43 to permit fuel to directly enter the cylinders 1*c* and 1*d*, and the excess fuel will be discharged through the restrictor 34. Thus, the construction injects a charge of fuel to the non-firing cylinders only on rapid acceleration from idle speed to provide a smooth acceleration under these conditions.

While the above description has illustrated the invention with a four cylinder engine, it is contemplated that the invention can be used with any multi-cylinder, two-stroke engine, and one or more cylinders can be non-firing at idle speeds. Further, it is not essential that an individual carburetor be associated with each cylinder, but instead a carburetor can be associated with the firing cylinders and a second carburetor associated with the non-firing cylinders.

Various modes of carrying out the invention are contemplated as being within the scope of the following claims particulary pointing out and distinctly claiming the subject matter which is regarded as the invention.

I claim:

1. In an internal combustion engine having at least a pair of cylinders, carburetor means for each cylinder of said pair for supplying a mixture of fuel and air to the respective cylinder, each carburetor means being constructed and arranged to supply a combustible fuel-air ratio at an off-idle engine speed, and means responsive to a decrease in engine speed from said off-idle speed to idle speed for restricting the amount of fuel supplied by one of said carburetor means to the respective cylinder to provide a fuel-air mixture too lean to fire.

2. In an internal combustion engine, a first cylinder, a second cylinder, a first carburetor connected to said first cylinder, a second carburetor connected to said second cylinder, each carburetor including an air passage and fuel inlet port means for supplying fuel to said passage, a shutter valve in each passage and movable between an open and closed position, each shutter valve having an opening therein, the inlet port means of said first carburetor being constructed and arranged to supply sufficient fuel to said first cylinder when said shutter valve is closed to permit firing of said first cylinder and the inlet port means of said second carburetor being constructed and arranged to supply a quantity of fuel to said second cylinder insufficient to fire when said shutter valve is in the closed position.

3. The engine of claim 2, wherein said inlet port means of said second carburetor is constructed and arranged to supply a sufficient quantity of fuel to said second cylinder to permit said second cylinder to fire when said shutter valve is in an open position.

4. The engine of claim 2, wherein each inlet port means comprises a first port located downstream of said shutter valve when said shutter valve is in the closed position, and a second port located upstream of said shutter valve when said shutter valve is in the closed position, the first port of said inlet port means of said second carburetor having a smaller cross-sectional area than the first port of said inlet port means of said first carburetor.

5. In a multi-cylinder two-stroke internal combustion engine, a first cylinder, a second cylinder, a first carburetor connected to said first cylinder, a second carburetor connected to said second cylinder, each carburetor having an air passage, a shutter valve disposed within each passage and movable between a closed and open position, aperture means in said shutter valve, each carburetor including idle port means connected to a source of fuel and exposed to the downstream side of said shutter valve when said shutter valve is in the closed position and each carburetor including off-idle port means connected to a source of fuel and exposed to the upstream side of said shutter valve when said shutter valve is in the closed position, said idle port means of a first of said carburetors being constructed and arranged to supply sufficient fuel when the shutter valve is in the closed position to provide a combustible fuel-air mixture, and the idle port means of the second of said carburetors being constructed and arranged to supply insufficient fuel when said shutter valve is in the closed position to supply an incombustible fuel-air mixture to said second cylinder, movement of said shutter valve in said second carburetor to a predetermined open position acting to expose the respective off-idle port means to the downstream side of said shutter valve to thereby supply a combustible mixture of fuel and air to said second cylinder.

6. The engine of claim 5, wherein the idle port means of said second carburetor has a smaller cross-sectional area than the idle port means of said first carburetor.

7. The engine of claim 5, wherein the longitudinal spacing between the off-idle port means and the peripheral edge of the shutter valve when said valve is in the closed position in said second carburetor is greater than that in said first carburetor.

8. In an internal combustion engine, a plurality of cylinders, carburetor means for supplying a mixture of fuel and air to each cylinder, the carburetor means associated with at least one of said cylinders being constructed and arranged to supply a fuel-air mixture to said one cylinder at idle speed that is too lean to fire, and fuel supply means separate from said carburetor means for supplying a charge of fuel directly to said one cylinder on rapid acceleration from said idle speed.

9. In an internal combustion engine, a plurality of cylinders, carburetor means for supplying a mixture of fuel and air to each cylinder, a main fuel line connecting each carburetor means and a source of fuel, a fuel pump in said main fuel line for supplying fuel to each carburetor means, the carburetor means associated with at least one of said cylinders being constructed and arranged to supply a fuel-air mixture to said one cylinder at idle speed that is too lean to fire, a bypass line interconnecting the main fuel line at a first junction disposed downstream of said fuel pump to said main fuel line at a second junction located upstream of said fuel pump, pumping means disposed in said bypass line, restrictor means in said bypass line and located between said pumping means and said second junction, injector means connected to said one cylinder and disposed in said bypass line between said pumping means and said restrictor means, said pumping means being constructed and arranged to increase the pressure of said fuel in said bypass line downstream of said pumping means on a rapid acceleration from idle speed, said injector means being constructed and arranged to discharge a quantity of fuel to said one cylinder when said pressure in said bypass line increases above a predetermined value.

10. The engine of claim 9, and including throttle lever means for controlling the speed of said engine, said pumping means being operably connected to said throttle lever means.

11. The engine of claim 9, wherein said injector means includes a passage providing communication between the bypass line and said one cylinder, and check valve means disposed within said passage, said check valve means disposed to open said passage when the pressure in the bypass line increases above said predetermined value.

12. The engine of claim 9, wherein said restrictor is constructed and arranged to provide an increase in pressure in said bypass line upstream of said restrictor means on rapid acceleration of speed from said idle speed, and said restrictor means being constructed and arranged to prevent a substantial increase of pressure in said bypass line upstream of said restrictor means on gradual acceleration from said idle speed.

13. The engine of claim 8, and including means for discharging any vapor build-up in said fuel supply means.

* * * * *